United States Patent [19]

Dobrusskin et al.

[11] Patent Number: 4,801,840

[45] Date of Patent: Jan. 31, 1989

[54] DISCHARGE LAMP HAVING AUTOMATICALLY CONTROLLED PREHEATING DEVICE ATTACHED TO ENVELOPE

[75] Inventors: Alexander Dobrusskin, Taufkirchen; Jürgen Heider, Munich; Wolfgang Schade, Kirchheim, all of Fed. Rep. of Germany

[73] Assignee: Patent Treuhand Gesellschaft für elektrische Glühlampen mbH, Munich, Fed. Rep. of Germany

[21] Appl. No.: 90,030

[22] Filed: Aug. 27, 1987

[30] Foreign Application Priority Data

Sep. 5, 1986 [DE] Fed. Rep. of Germany ..... 3630335

[51] Int. Cl.[4] ..... H01J 61/52; H05B 41/231

[52] U.S. Cl. ..... 313/44; 313/15; 313/42; 313/43; 315/116; 315/117

[58] Field of Search ..... 315/112, 115, 174, 175, 315/117, 116; 313/13, 15, 39, 42, 43, 44

[56] References Cited

U.S. PATENT DOCUMENTS

| | | | |
|---|---|---|---|
| 3,898,494 | 8/1975 | Levy | 315/15 |
| 4,722,039 | 1/1988 | Gavgel | 315/15 X |
| 4,734,612 | 3/1988 | Sasaki et al. | 315/15 |

*Primary Examiner*—Leo H. Boudreau
*Assistant Examiner*—Mark R. Powell
*Attorney, Agent, or Firm*—Frishauf, Holtz, Goodman & Woodward

[57] ABSTRACT

To provide for preheating of a high-pressure discharge lamp (6) having a discharge vessel (7) closed off by a pinch or press seal (8), a ceramic holder (1), typically a ceramic tube with multiple capillary openings therein, has a heating wire threaded through the capillary openings, and the ceramic holder is located in intimate thermal transfer with respect to the lamp, for example by being placed and cemented in the transition zone between the discharge vessel (7) and the pinch or press seal. Heater power of about 10 W applied to two such ceramic capillary heaters located adjacent both sides of the pinch or press seal permits preheating the fill of the lamp so that 40% of rated light output can be obtained within several seconds after energization of the electrodes. The lamp is suitable as a headlamp for vehicular use and can be constructed in miniature size, with a discharge vessel volume in the range of 100ths $cm^3$. The ceramic heater together with the supply connection, also within an aperture ceramic tube, forms a generally T-shaped assembly. The heater is maintained in energized condition upon periods when the lamp is deenergized and has its own power supply.

17 Claims, 3 Drawing Sheets

DISCHARGE LAMP HAVING AUTOMATICALLY CONTROLLED PREHEATING DEVICE ATTACHED TO ENVELOPE

REFERENCE TO RELATED DISCLOSURES

British Pat. No. 530,376
U.S. Pat. No. 2,820,164, Retzer.

The present invention relates to high-pressure discharge and more particularly to a high-pressure discharge lamp having a metal halide fill and especially to lamps of low power, for example of less than 100W and especially 50W and less, which are suitable for use in vehicular headlamps.

BACKGROUND

High-pressure metal halide discharge lamps are increasingly used for general illumination. It has been proposed to use such lamps also as headlamps of vehicles, and particularly automotive vehicles. Headlamps require only comparatively low power light sources, that is, less than 100W and especially less than 50W; a power rating of 35W has been proposed. The quality of the obtained light, that is, its color index and radiation temperature is suitable for use in headlamps. Known fills can satisfy the requirements. For rapid starting, preheating of the electrodes is desirable.

British Pat. No. 530,376 describes a high-pressure discharge lamp with two melt connections. A heater winding is located about a portion of the discharge vessel which is located in a capillary opening of quartz glass, coupled to the discharge vessel. The heating filment is operable separately from the lamp. The fill substances within the discharge vessel are intended to be vaporized by the separate heating winding, so that the starting time of the lamp is reduced and full light output is more rapidly obtained than without preheating.

U.S. Pat. No. 2,820,164 decribes a high-pressure discharge lamp which is heated at both ends. The lamp is designed for combination with an optical system. A plurality of ceramic rods, each supplied with a heater resistance wire, are located about the ends of the discharge vessel, spaced therefrom, in order to provide radiant heat towards the discharge vessel to heat the discharge vessel and to maintain the fill substances therein in vaporized condition. Instantaneous light output from the lamp can be obtained thereby. The mechanical structure of such a heater arrangement is complex and heat transfer to the discharge vessel from the outside thereof is not efficient; the arrangement is not suitable for use with very small lamps, for example intended for vehicular applications.

THE INVENTION

It is an object to provide a high-pressure discharge lamp which can be preheated, and in which a heating wire is directly coupled to the lamp in such a manner that it can be easily assembled therewith and, additionally, is held permanently retained on predetermined positions on the lamp, in intimate contact therewith.

Briefly, a ceramic holder formed with apertures therein, for example capillary apertures, retains resistance heating elements, typically heating wires in the apertures of the ceramic holder. The heating arrangement is located in the transition zone between the bulb of the discharge vessel and a pinch or press seal thereof.

Preferably, the ceramic holder has a plurality of apertures, that is, capillary openings, and the heating wire is snaked therethrough in undulating arrangement. The ceramic capillary holder is positioned in tight thermal heat transfer relation to the lamp, preferably by being cemented thereto.

In accordance with a preferred feature of the invention, the connections to the heated wire extend at right angles to the heater wire so that a heater wire-connection arrangement in general T-shape is provided.

In accordance with a feature of the invention, the lamp is operated by two separately controlled voltage sources, so that, in effect, the heater arrangement can be operated independently of the lamp electrodes, that is, from an individually assigned voltage source. This voltage source can be arranged to continuously heat the lamp, even though the lamp electrodes are deenergized, thus ensuring rapid starting.

The lamp has the advantage that placing the heater wire in a multiple capillary ceramic holder which is in intimate thermo contact with the lamp, ensures high heat concentration in the region where heat is mostly needed. The connecting leads to the ceramic capillary holder my remaian cold. Utilizing a multiple capillary permits a long heater wire, which can be so connected that it can change size due to thermal expansion and contraction without any constraint by the ceramic holder.

Use of ceramic capillaries has the additional advantage that multiple ceramic capillary tubes are commercial articles made under mass-production conditions, and thus are inexpensive. Further, they protect the heater wire against oxidation.

A typical size of the discharge vessel may have a volume of only about 0.03 $cm^3$. A thin heater wire in a ceramic capillary holder is sufficient to preheat the fill substances within the small volume. Preferably, both opposed sides of the pinch or press seal have a multiple capillary ceramic holder with a heater wire attached to the lamp.

DRAWINGS

DETAILED DESCRIPTION

Figure 1:
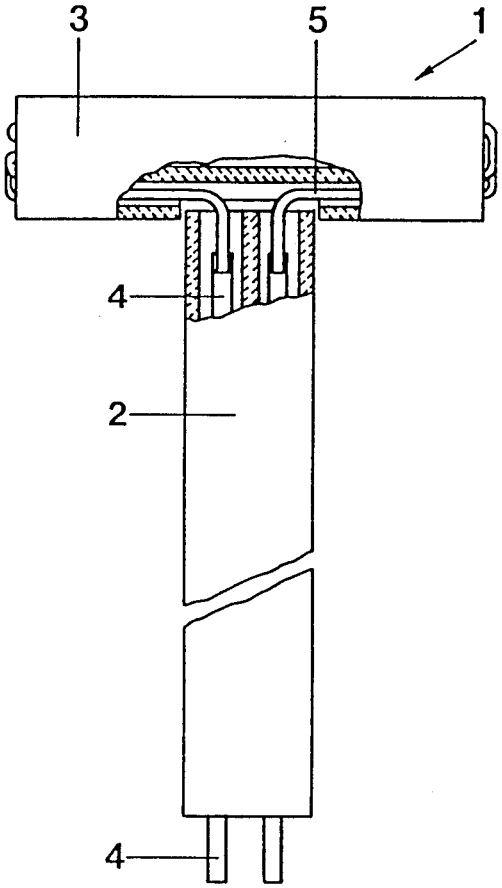
FIG. 1 is a front view, partly broken open and in section of heater/arrangement for a miniature discharge lamp.
Figure 2:
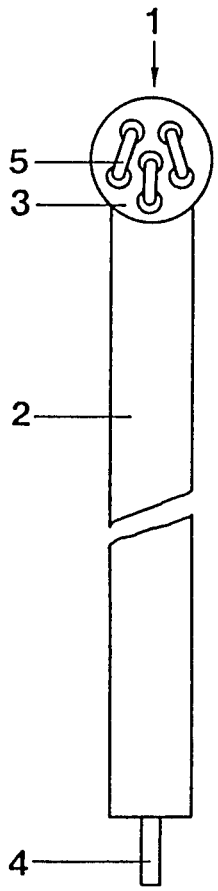
FIG. 2 is a side view of the heater arrangement of FIG. 1, that is, rotated 90° with respect to FIG. 1.

The heater element 1—see FIGS. 1 and 2—includes a dual capillary tube 2 and a multiple capillary tube 3. The tubes are located essentially at right angle to each other to define, in general, a T-shape. The dual capillary tube 2 is located approximately in the center, and at right angles to the multiple capillary tube 3. Both capillaries 2,3 are made of aluminum oxide ceramic, and are commercial articles. The dual capillary 2 has two connecting leads 4 located therein. The heater wire 5, made, for example, of a heater wire known as Kanthal—registered TM—is threaded through the openings or apertures of the multiple capillary tube 3, undulating back and forth, as best seen when comparing FIGS. 1 and 2. Depending on the type of multiple capillary tube used, different lengths of heater wire 5 may be accepted therein, so that the heater power can be matched to the lamp, within some limits of course. In the example selected, the multiple capillary tube 3 has six single capillary openings, so that the heater wire 5 is passed six times through the length of the multiple capillary tube 3. The length of the capillary 3 is matched to the width of the lamp press or seal 8 (FIG. 3).

Figure 3:
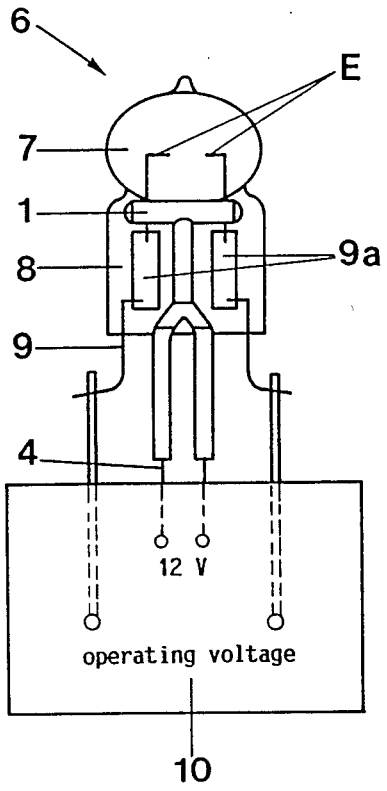
FIG. 3 is a schematic front view of a miniture metal halide discharge lamp with the heater arrangement in accordance with the present invention.
Figure 4:
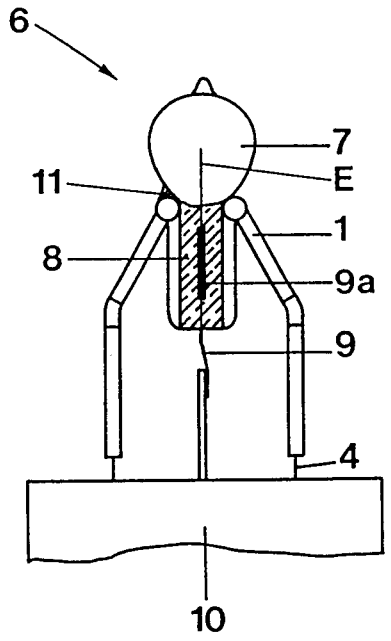
FIG. 4 is a side view of the lamp of FIG. 3, partly in section.

FIGS. 3 and 4 show the lamp with the heater arrangement connected thereto. A metal halide high-pressure discharge lamp 6 has a press or pinch seal 8 at one end. A heater arrangement 1 is located on each side of the lamp at the transition region or zone between the bulb 7 and the pinch or press seal 8—see FIG. 4. The connection of the heater arrangements 1 to the lamp 2 is a cement 11, shown only on one side in FIG. 4 for clarity of illustration. Good heat transmission between the capillary tube 3 and the lamp in the transition zone, and where the fill requires heating to permit starting of an arc between the electrodes E is thereby ensured. The current supply leads 9 include a molybdenum foil 9*a*, pinch- or press-connected in the pinch seal 8. The current supply leads 9 terminate in a base body 10 which provides operating energy for the electrodes E of the lamp. The connecting lines 4 likewise terminate in the base body 10 where they are suitably connected, for example in series.

OPERATION

The high-pressure discharge lamp with a fill volume of about 0.03 $cm^3$ has a power rating of about 35W. It is operated at a lamp voltage of about 100V, with 0.35A current supply. Each one of the two heaters 1 requires about 10W, which is sufficient to preheat the discharge vessel 7 to a temperature up to about 550° C., which is sufficient to permit rapid starting of the lamp 6.

The fill within the lamp contains mercury and sodium and scandium halides. When the lamp is fully operating, it has a light flux of over 2,400 lumens with a color temperature of about 3,400° K.

Figure 5:
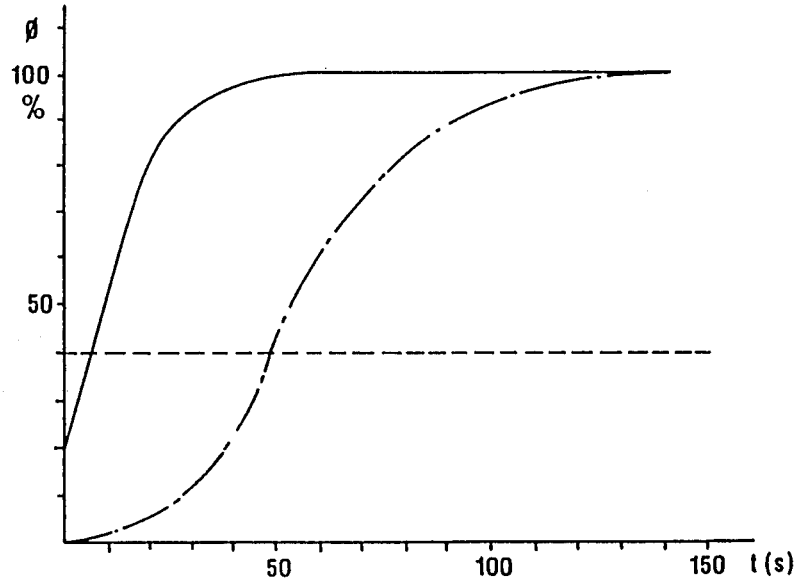
FIG. 5 is a graph illustrating light flux (ordinate) with respect to time (abscissa) of a lamp in accordance with the present invention—solid line—and a prior art lamp without a heater arrangement—chain-dotted line.

FIG. 5 illustrates the operating curves of a metal halide high-pressure discharge lamp as described, with and without preheating. Also shown, by the broken line, is the light output of a conventional comparable H4 halogen incandescent lamp, customarily used for automotive headlights.

The graph clearly shows that the H4 lamp provides only about 40% of the light flux of a metal halide high-pressure discharge lamp. The 40% light output of the preheated high-pressure discharge lamp is reached after about 7 seconds. Fifty percent of the light flux is obtained after 9 seconds and 90% of the light flux after about 29 seconds. In contrast, and without preheating, about 44 seconds are required to obtain 40% of the light flux—comparable to the H4 halogen incandescent lamp—54 seconds for 50% light lfux and over a minute, that is about 85 seconds to obtain 90% of light flux output.

Various changes and modifications may be made within the scope of the inventive concept.

A suitable ceramic element 3 with multiple capillary openings is an aluminum oxide ceramic having an outer diameter of 2.0 millimeters, with six longitudinal capillary openings of 0.3 millimeter diameter. The Kanthal (registered TM) wire is a fine wire of outer diameter just under the opening size of the capillaries. The connecting leads 4 can be made of nickel, connected to the Kanthal heater wires by spot welding. The ceramic body 2, likewise, is an aluminum oxide tube, with openings which, however, are much wider, for example of about 0.8 mm to accept the connection to the heater wires 5, and introduce minimum power loss since no heating of the pinch or press seal as such is required. A typical independent power supply for the heater filaments 5 is a 12V source, for example a vehicular battery.

We claim:

1. A single-walled high-pressure metal halide discharge lamp having a discharge vessel (7);

two spaced electrodes (E) located in the discharge vessel;

a fill substance sustaining a discahrge arc within the discharge vessel upon energization of the electrodes and striking of an arc therebetween;

a pair of current lead means (9) extending from outside of the discharge vessel to the electrodes;

a pinch or press seal (8) retaining said current lead means in position; and a heating means (1), thermally coupled to the discharge vessel (7), including a resistance heating means (5), wherein, the lamp heating means (1) comprises an elongated ceramic holder (2,3) formed with apertures therein, having at least one elongated portion (3) directly contacting said discharge vessel along a longitudinal surface of said elongated portion (3), and wherein the resistance heating means (5) are located in the apertures of the ceramic holder.

2. The lamp of claim 1, wherein the resistance heating means (5) comprises a heating wire.

3. The lamp of claim 1, wherein the ceramic holder is located outside of the discharge vessel, adjacent the pinch or press seal (8) and in the region of transition between the discharge vessel (7) and the pinch or press seal (8).

4. The lamp of claim 3, wherein the resistance heating means (5) comprises a heating wire.

5. The lamp of claim 3, wherein the ceramic holder comprises a multiple aperture ceramic holder formed with capillary-type apertures, and the heating means comprises heating wires located in said capillary-type apertures and threaded therethrough.

6. The lamp of claim 3, wherein the ceramic holder is intimately thermally coupled to the lamp in the region of the transition between the discharge vessel and the pinch or press seal.

7. The lamp of claim 5, wherein the ceramic holder is intimately thermally coupled to the lamp in the region of the transition between the discharge vessel and the pinch or press seal.

8. The lamp of claim 6, further including a cement connection (11) between the ceramic holder and the lamp in the region of the transition between the discharge vessel (7) and the pinch or press seal.

9. The lamp of claim 7, further including a cement connection (11) between the ceramic holder and the lamp in the region of the transition between the discharge vessel (7) and the pinch or press seal.

10. The lamp of claim 3, including a supply connection comprising a ceramic supply holder (2) formed with dual apertures;

and connecting leads (4) positioned in respective ones of the dual apertures for connection to the resistance heating means (5).

11. The lamp of claim 10, wherein the ceramic connection supply holder and the elongated ceramic holder form a generally T-shaped assembly.

12. The lamp of claim 1, wherein the lamp has a power rating of about 50W or less and the discharge vessel (7) has a fill volume in the order of 100ths $cm^3$.

13. The lamp of claim 12, wherein the fill volume of the discharge vessel is in the order of about 0.03 $cm^3$.

14. The lamp of claim 13, including current supply means connected to the current lead means (9) for the electrodes (E);

and separate current supply means connected to the resistance heating means (5).

15. The lamp of claim 14, wherein the separate current supply means for the resistance heating means (5) are separately controllable to provide for continued energization of the resistance heating means during the absence of energization of the current lead means to supply operating energy to the electrodes (E).

16. Method to operate a high-pressure discharge lamp as claimed in claim 1 comprising separately energizing the current lead means (9) providing operating energy to the electrodes (E) and the resistance heating means (5) for preheating the lamp.

17. The method of claim 16, including the step of continuing supplying electrical energy to the resistance heating means (5) upon periods when the current supply leads and hence the electrodes (E) are deenergized.

* * * * *